US008442802B2

(12) United States Patent
Sung et al.

(10) Patent No.: US 8,442,802 B2
(45) Date of Patent: May 14, 2013

(54) METHOD OF DIAGNOSING AIR CONDITIONER AND MOBILE TERMINAL EQUIPMENT FOR PERFORMING METHOD

(75) Inventors: Dongwon Sung, Seoul (KR); Deok Huh, Seoul (KR); Jiwoong Kim, Seoul (KR); Gilbong Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 360 days.

(21) Appl. No.: 12/780,223

(22) Filed: May 14, 2010

(65) Prior Publication Data

US 2010/0292960 A1 Nov. 18, 2010

(30) Foreign Application Priority Data

May 15, 2009 (KR) ..... 10-2009-0042736

(51) Int. Cl.
*G06F 11/30* (2006.01)
*G06F 19/00* (2011.01)
*H04M 11/00* (2006.01)

(52) U.S. Cl.
USPC ..... 702/184; 379/102.05; 700/108

(58) Field of Classification Search ..... 702/184, 702/33–36, 57–59, 81, 84, 108, 113, 122, 702/127, 182–183, 185, 188–189; 340/3.1, 340/3.43–3.44, 4.11, 286.02, 531, 539.1, 539.24, 870.01, 870.04–870.05; 379/1.01, 379/90.01, 93.01, 102.01–102.03, 102.05, 379/106.01; 700/9, 17–18, 21, 108–110, 700/275–276
See application file for complete search history.

(56) References Cited

FOREIGN PATENT DOCUMENTS

| | | | |
|---|---|---|---|
| EP | 0 986 239 | | 3/2000 |
| EP | 1 662 210 | | 5/2006 |
| EP | 2 037 191 | | 3/2009 |
| KR | 10-2007-0115451 | | 12/2007 |
| KR | 2007115451 A | * | 12/2007 |
| KR | 10-2008-0022959 | | 3/2008 |

OTHER PUBLICATIONS

KR 10-2007-0115451, Dec. 6, 2007, 10 pp.*
KR 10-2007-0115451, Dec. 6, 2007, English Version, 12 pp.*
European Search Report dated Apr. 24, 2012.

* cited by examiner

*Primary Examiner* — Toan Le
(74) *Attorney, Agent, or Firm* — KED & Associates LLP

(57) ABSTRACT

A method of diagnosing an air conditioner and mobile terminal equipment for performing the method are provided. The method of diagnosing the air conditioner using mobile terminal equipment includes beginning diagnosis of the air conditioner, displaying a diagnostic result of the air conditioner on a screen, and displaying a countermeasure for the diagnostic result.

10 Claims, 6 Drawing Sheets

METHOD OF DIAGNOSING AIR CONDITIONER AND MOBILE TERMINAL EQUIPMENT FOR PERFORMING METHOD

CROSS-REFERENCE TO RELATED APPLICATION

This application claims the benefit of Korean Application No. 10-2009-0042736, filed on May 15, 2009 in the Korean Intellectual Property Office, the disclosure of which is incorporated herein by reference.

BACKGROUND OF THE INVENTION

1. Field of the Invention

The present invention relates to a method of diagnosing an air conditioner and mobile terminal equipment for performing the method, and more particularly, to a method of diagnosing an air conditioner, which is able to reduce a service time and to improve efficiency without using a separate diagnostic device, and mobile terminal equipment for performing the method.

2. Description of the Related Art

An air conditioner ejects cold/hot air to a room so as to adjust an indoor temperature and to purify indoor air, thereby providing a pleasant environment. In general, the air conditioner includes an indoor unit including a heat exchanger and mounted in a room and an outdoor unit which includes a compressor, a heat exchanger and the like and supplies refrigerant to the indoor unit.

If a report on a failure of or a complaint about such an air conditioner is received from a consumer, the air conditioner is diagnosed using a specific diagnostic device and is then replaced or repaired. However, this method may not adequately cope with the complaint (e.g., a complaint about poor air conditioning and heating) of the consumer and may not accurately cope with a failure item.

SUMMARY OF THE INVENTION

Therefore, the present invention has been made in view of the above problems, and it is an object of the present invention to provide a method of diagnosing an air conditioner using mobile terminal equipment instead of a specific diagnostic device.

It is another object of the present invention to provide a method of diagnosing an air conditioner, which is able to cope with a complaint of a consumer, and mobile terminal equipment for performing the method.

It is another object of the present invention to provide a method of diagnosing an air conditioner, which is able to reduce a service time and to improve efficiency using a schematic service, and mobile terminal equipment for performing the method In accordance with an aspect of the present invention, the above and other objects can be accomplished by the provision of a method of diagnosing an air conditioner using mobile terminal equipment, including beginning diagnosis of the air conditioner; displaying a diagnostic result of the air conditioner on a screen; and displaying a countermeasure for the diagnostic result.

In accordance with another aspect of the present invention, there is provided a method of diagnosing an air conditioner, including receiving a diagnosis command from mobile terminal equipment; beginning a specific operation mode according to the diagnosis command; and transmitting a diagnostic result according to the specific operation mode to the mobile terminal equipment.

In accordance with another aspect of the present invention, there is provided mobile terminal equipment including a control unit configured to begin diagnosis of an air conditioner; a communication unit configured to transmit a diagnosis start command of the air conditioner and to receive a diagnostic result from the air conditioner; and an output unit configured to display the received diagnostic result.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENTS

Figure 1:
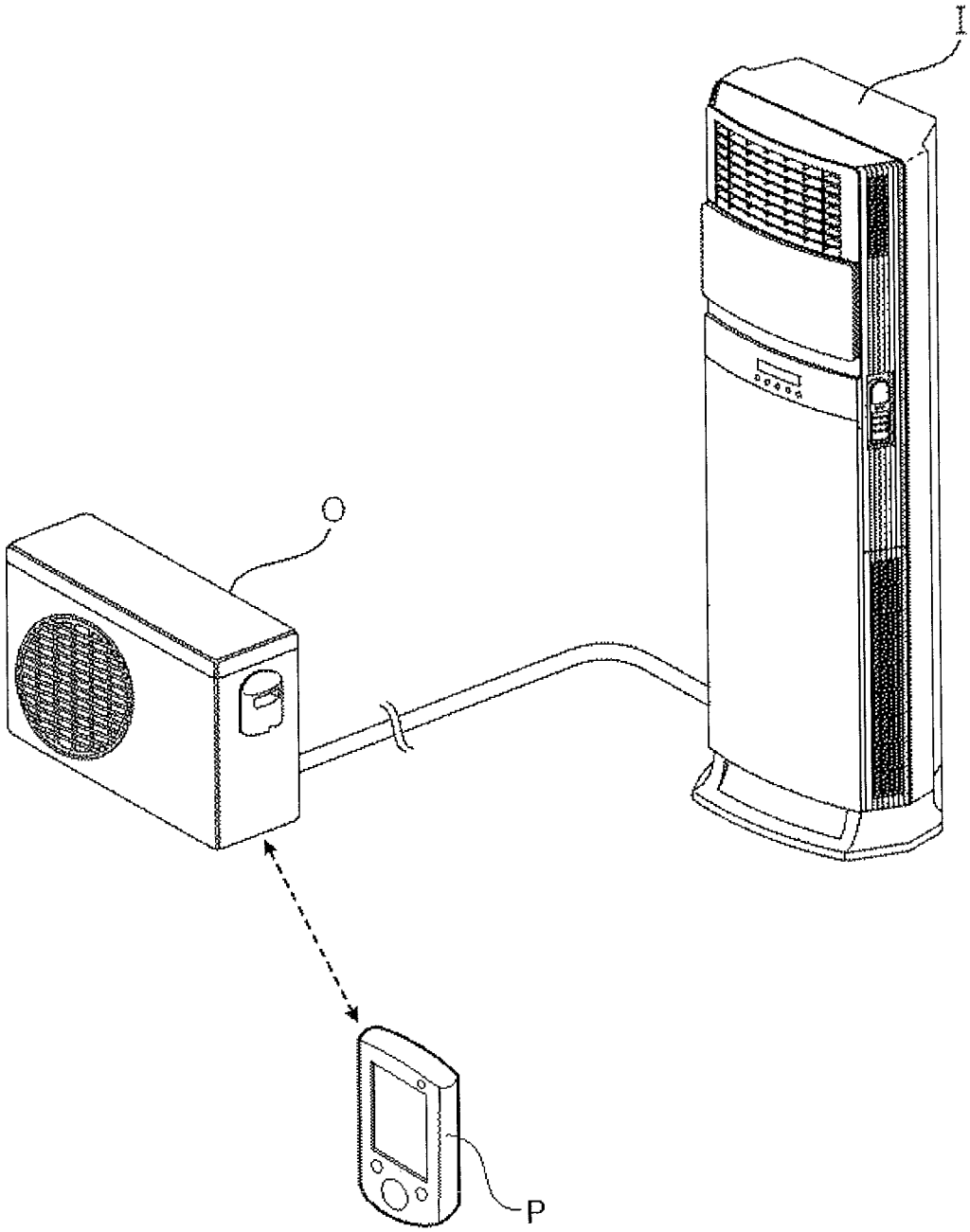
FIG. 1 is a systematic diagram of a method of diagnosing an air conditioner according to an embodiment of the present invention.

The advantages and features of the present invention, and the way of attaining them, will become apparent with reference to embodiments described below in conjunction with the accompanying drawings. However, the present invention is not limited to the embodiments disclosed below and will be embodied in a variety of different forms; rather, these embodiments are provided so that this disclosure will be thorough and complete, and will fully convey the scope of the present invention to those skilled in the art, and the scope of the present invention will be defined by the appended claims. Like reference numerals refer to like elements throughout the specification.

Now, exemplary embodiments of a method of diagnosing an air conditioner and mobile terminal equipment for performing the method according to the present invention will be hereinafter described in detail with reference to the accompanying drawings.

FIG. 1 is a systematic diagram of a method of diagnosing an air conditioner according to an embodiment of the present invention.

A system for diagnosing an air conditioner according to an embodiment of the present invention includes an indoor unit I, an outdoor unit O and mobile terminal equipment P.

The indoor unit I is mounted in a room so as to adjust an indoor temperature and to purify indoor air. The indoor unit I includes a heat exchanger to heat-exchange indoor air and refrigerant. The indoor unit I may include an expansion valve to expand refrigerant.

The outdoor unit O is mounted outside a room so as to heat-exchange indoor air and refrigerant. The outdoor unit O may include an expansion valve to expand refrigerant.

The mobile terminal equipment P is electronic equipment capable of communicating with other equipment and displaying information on a screen. Examples of the mobile terminal equipment P include a mobile phone, a Personal Digital Assistant (PDA), a notebook type Personal Computer (PC), an Ultra Mobile PC, and the like. In the embodiment of the present invention, a PDA is used.

The mobile terminal equipment P may include a processor such as a single chip, a multi-chip or an Application Specific Integrated Circuit (ASIC) and a storage device such as a Random Access Memory (RAM), a Read Only Memory (ROM), an Erasable Programmable Read Only Memory (EPROM) or a hard disk. In the mobile terminal equipment P, an operating system such as Windows OS, Mac OS, OS/2, DOS, Unix, Linux, Windows Mobile OS, Symbian OS or Palm OS may be installed. In the mobile terminal equipment P, an application program for diagnosing an air conditioner, which is written in C/C++, JAVA, BASIC or the like, may be installed.

The mobile terminal equipment P and the outdoor unit O communicate with each other, for diagnosis of the air conditioner. The mobile terminal equipment P and the outdoor unit O may be connected by wire through an interface such as RS-232 or a Universal Serial Bus (USB) or connected wirelessly through wireless LAN or Bluetooth. Although the mobile terminal equipment P and the outdoor unit O communicate with each other in the embodiment of the present invention, the mobile terminal equipment P and the indoor unit I may communicate with each other.

Figure 2:
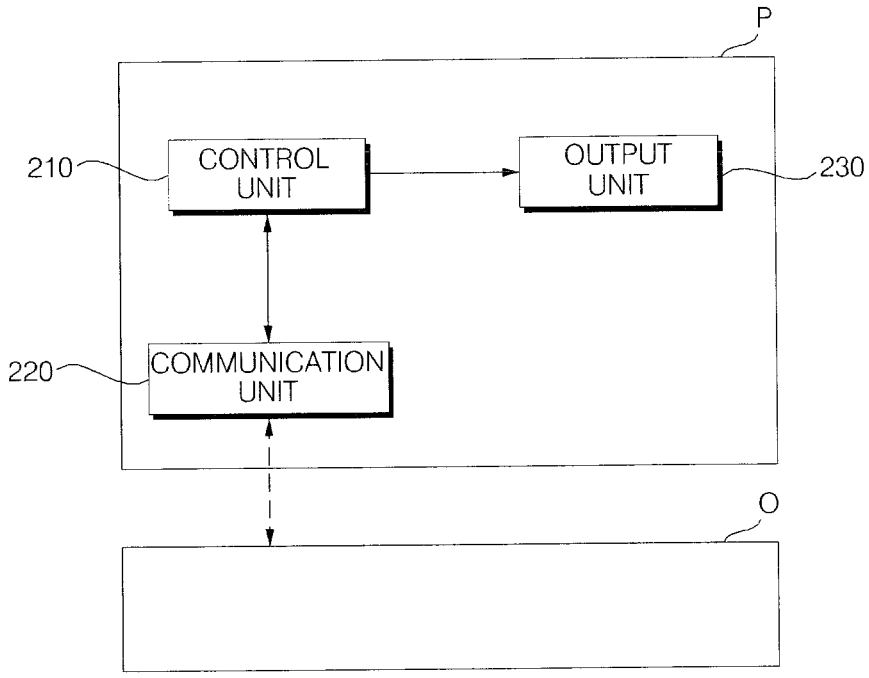
FIG. 2 is a block diagram of mobile terminal equipment according to an embodiment of the present invention.

FIG. 2 is a block diagram of mobile terminal equipment according to an embodiment of the present invention.

The mobile terminal equipment of the embodiment of the present invention includes a control unit 210 for controlling diagnosis of the air conditioner, a communication unit 220 for communicating with the outdoor unit O of the air conditioner, and an output unit 230 for outputting a variety of information and data on a screen.

The control unit 210 controls the communication unit 220 and the output unit 230 so as to perform the diagnosis of the air conditioner. The control unit 210 begins to diagnose the air conditioner when a service provider or a user inputs a diagnostic command of the air conditioner. The control unit 210 begins to diagnose the air conditioner and controls the communication unit 220 to transmit a diagnosis start command to the outdoor unit O.

The control unit 210 analyzes a diagnostic result received from the communication unit 220 and selects a countermeasure for the diagnostic result. The control unit 210 controls the output unit 230 to display the diagnostic result and the countermeasure on the screen.

The communication unit 220 transmits the diagnosis start command to the outdoor unit O and receives the diagnostic result from the outdoor unit O. The communication unit 220 communicates with the outdoor unit O according to a predetermined communication protocol, under the control of the control unit 210. The communication unit 220 transmits the diagnosis start command to the outdoor unit O under the control of the control unit 210. The communication unit 220 receives the diagnostic result from the outdoor unit O and transmits the diagnostic result to the control unit 210.

The output unit 230 displays the diagnostic result on the screen and displays the countermeasure for the diagnostic result on the screen. The output unit 230 displays the diagnostic result or the countermeasure on the screen of the mobile terminal equipment P under the control of the control unit 210. The screen of the mobile terminal equipment P may be implemented by a Liquid Crystal Display (LCD) or an Organic Light Emitting Diode (OLED).

At this time, the term "unit" used in the present embodiment refers to a software or hardware component such as a Field Programmable Gate Array (FPGA) or an ASIC, and performs any role. However, the term "unit" is not limited to the hardware or software component. The term "unit" may be configured in an addressable storage medium or configured to execute one or more processors.

Figure 3:
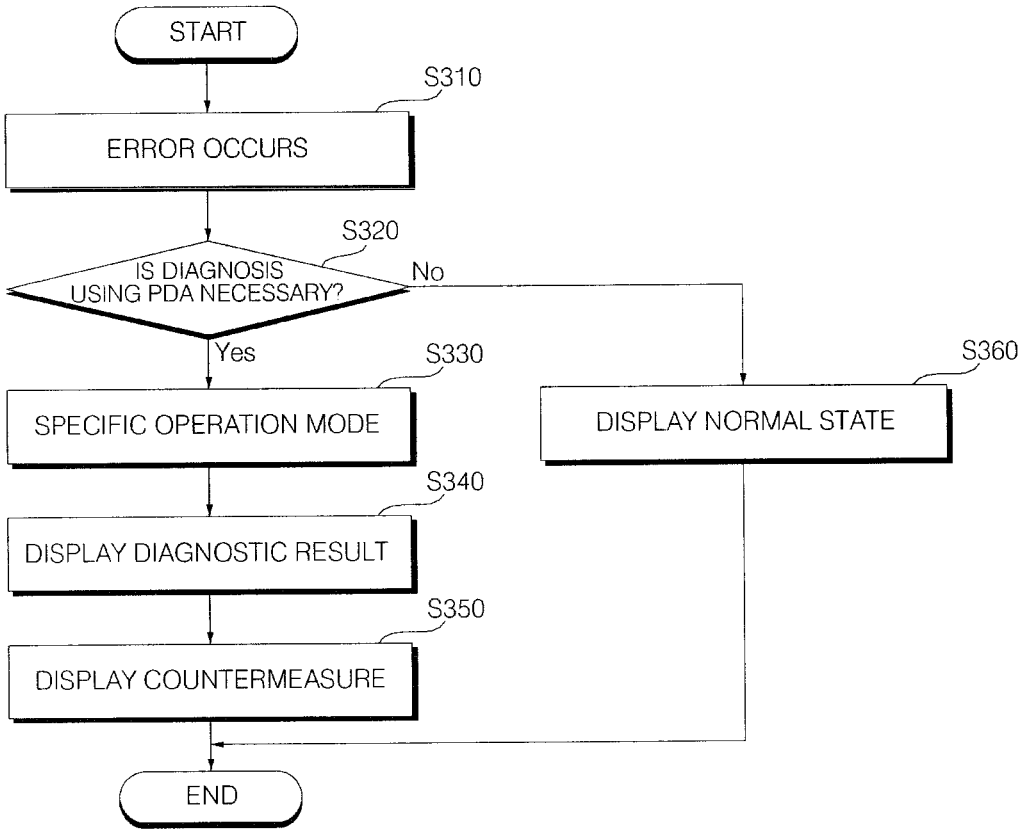
FIG. 3 is a flowchart illustrating a method of diagnosing an air conditioner according to an embodiment of the present invention.

FIG. 3 is a flowchart illustrating a method of diagnosing an air conditioner according to an embodiment of the present invention.

If an error occurs in an air conditioner and failure of the air conditioner is reported or a complaint of a consumer is received (S310), a service provider determines whether or not diagnosis using mobile terminal equipment is necessary (S320). Instead of the service provider, an engineer, a repairman or a general user may determine whether or not diagnosis using the mobile terminal equipment is necessary, and perform diagnosis. Alternatively, the mobile terminal equipment itself may determine whether or not diagnosis is necessary.

If diagnosis using the mobile terminal equipment P is necessary and the service provider or the user inputs a diagnosis start command, the control unit 210 of the mobile terminal equipment starts the diagnosis of the air conditioner, the communication unit 220 of the mobile terminal equipment transmits the diagnosis start command to the outdoor unit O, and the air conditioner operates in a specific operation mode (S330). The specific operation mode indicates a mode for controlling at least one of a compressor, an electronic expansion valve, a fan and a valve.

If the mobile terminal equipment itself determines whether or not diagnosis is necessary, the diagnosis of the air conditioner may begin without the input of the service provider or the user.

Even when an operation test is performed after mounting the air conditioner without determination of failure diagnosis, the service provider may diagnose the air conditioner using the mobile terminal equipment.

When the result of diagnosing the air conditioner which operates in the specific operation mode is transmitted to the mobile terminal equipment P, the communication unit 220 of the mobile terminal equipment P receives the diagnostic result and the output unit 230 displays the received diagnostic result on the screen (S340). In addition, the control unit 210 of the mobile terminal equipment P selects a countermeasure for the diagnostic result and the output unit 230 displays the countermeasure on the screen (S350).

The diagnostic result and the countermeasure may be displayed on one screen simultaneously or different screens consecutively. The countermeasure for the diagnostic result may be a guide to repair of the air conditioner. The service provider shows the displayed diagnostic result to the consumer and repairs the air conditioner or replaces a part with a new one according to the displayed countermeasure.

If the diagnosis using the mobile terminal equipment P is not necessary, information indicating that the air conditioner is in a normal state is displayed (S360). However, if a consumer complaint is received, an adjustment to be taken for solving the complaint may be displayed. The service provider shows the displayed adjustment to the consumer and solves the complaint of the consumer.

Figure 4:
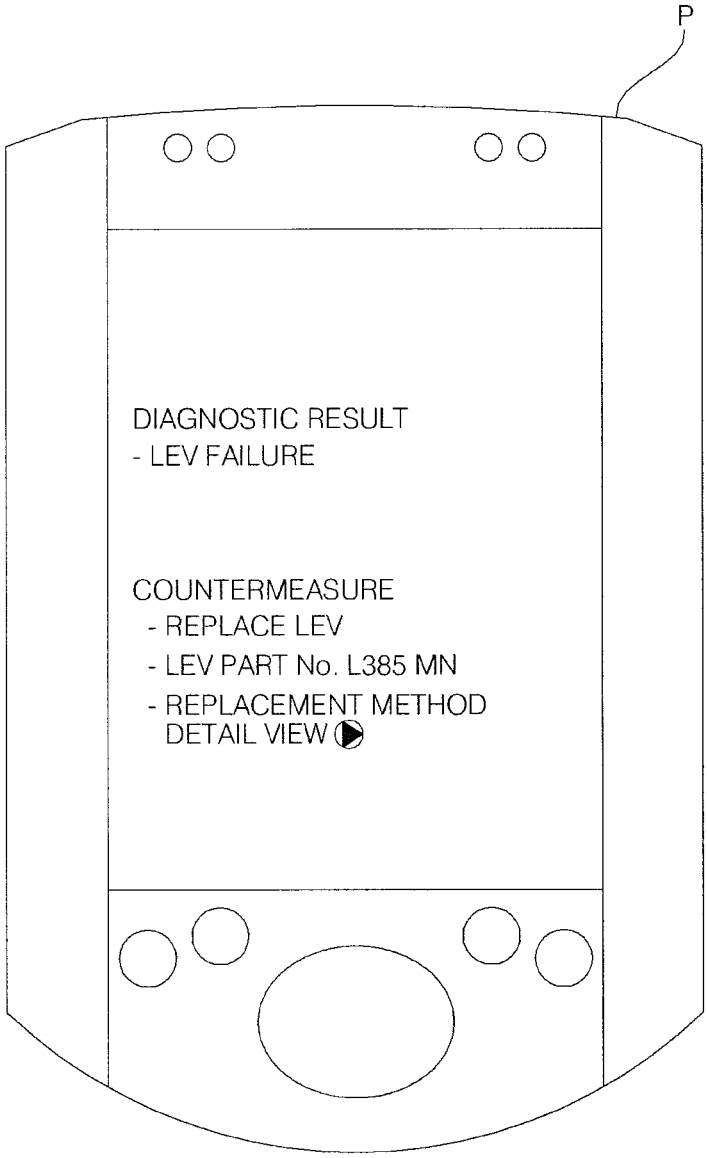
FIG. 4 is a diagram showing an example of displaying a diagnostic result and a countermeasure on mobile terminal equipment according to an embodiment of the present invention.

FIG. 4 is a diagram showing an example of displaying a diagnostic result and countermeasure on mobile terminal equipment according to an embodiment of the present invention.

As shown in FIG. 4, a diagnosis result may be displayed on the mobile terminal equipment and a replaced part number and a replacement method may be displayed as the countermeasure. The service provider shows the displayed diagnostic result to the consumer and repairs the air conditioner or replaces the part according to the displayed countermeasure.

Figure 5:
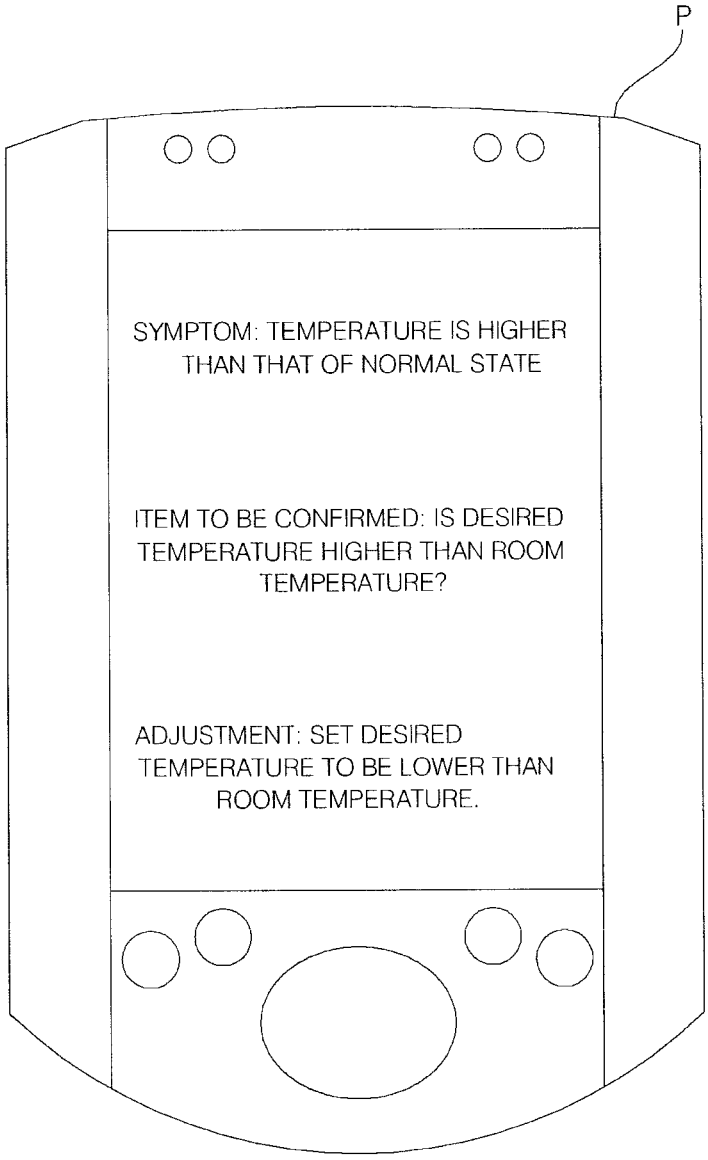
FIG. 5 is a diagram showing an example of displaying an adjustment in a normal state on mobile terminal equipment according to an embodiment of the present invention.

FIG. 5 is a diagram showing an example of displaying an adjustment in a normal state on mobile terminal equipment according to an embodiment of the present invention.

As shown in FIG. 5, a symptom, an item to be confirmed, and an adjustment to be taken may be displayed on the mobile terminal equipment. The service provider shows the displayed content to the consumer and solves the complaint of the consumer.

Figure 6:
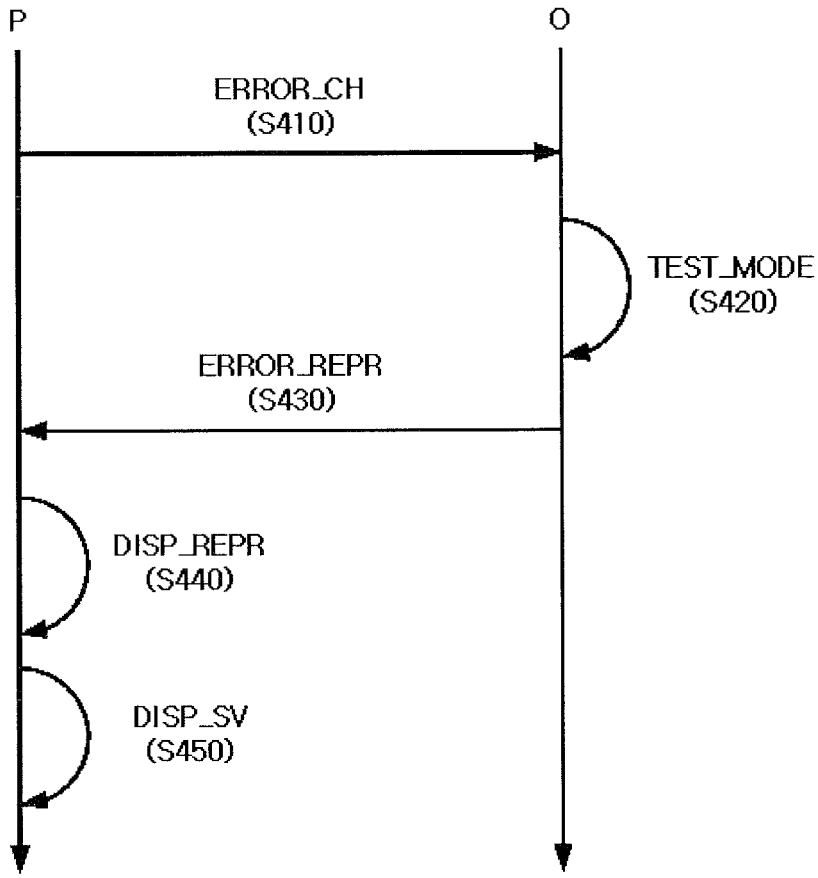
FIG. 6 is a diagram showing call processing of a method of diagnosing an air conditioner according to an embodiment of the present invention.

FIG. 6 is a diagram showing call processing of a method of diagnosing an air conditioner according to an embodiment of the present invention.

The mobile terminal equipment P transmits a diagnosis command ERROR_CH to the outdoor unit O (S410). When failure of an air conditioner is reported or a consumer complaint is received or when an operation test is performed after an air conditioner is initially mounted, the service provider determines whether or not diagnosis is necessary. If diagnosis is necessary, the diagnosis is performed using the mobile terminal equipment P and the mobile terminal equipment P transmits the diagnosis command ERROR_CH to the outdoor unit O.

When the outdoor unit O receives the diagnosis command ERROR_CH, the outdoor unit O performs a specific operation mode TEST_MODE (S420). The specific operation mode indicates a mode for controlling at least one of a compressor, an electronic expansion valve, a fan and a valve.

The outdoor unit O transmits a diagnosis result ERROR_REPR obtained when the air conditioner operates in the specific operation mode to the mobile terminal equipment P (S430). The mobile terminal equipment P displays the diagnosis result DISP_REPR on the screen (S440) and displays the countermeasure DISP_SV for the diagnosis result on the screen (S450).

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A method of diagnosing an air conditioner using mobile terminal equipment, the method comprising:

determining by a controller whether a diagnosis of the air conditioner using the mobile terminal equipment is necessary;

beginning the diagnosis of the air conditioner by the controller, if the diagnosis of the air conditioner using the mobile terminal equipment is determined to he necessary;

displaying by an output device a diagnostic result based on the diagnosis of the air conditioner on a screen;

displaying by the output device a countermeasure for the diagnostic result on the screen; and displaying by the output device an information that indicates that the air conditioner is in a normal state and an adjustment according to a symptom of the air conditioner on the screen, if the diagnosis of the air conditioner using the mobile terminal equipment is determined not to he necessary.

2. The method according to claim 1, further comprising transmitting a diagnosis start command by a communication device to the air conditioner when the diagnosis of the air conditioner begins.

3. The method according to claim 1, further comprising receiving the diagnostic result by a communication device from the air conditioner before the diagnostic result is displayed.

4. The method according to claim 1, wherein the countermeasure is a guide to repair the air conditioner.

5. A mobile terminal equipment, comprising:

a controller configured to determine whether a diagnosis of an air conditioner using a mobile terminal equipment is necessary and to begin the diagnosis of the air conditioner if the diagnosis of the air conditioner using the mobile terminal equipment is determined to be necessary;

a communication device configured to transmit a diagnosis start command of the air conditioner and to receive a diagnostic result from the air conditioner; and an output device configured to display the received diagnostic result, wherein the output device displays an information that indicates that the air conditioner is in a normal state and an adjustment according to a symptom of the air conditioner, if the diagnosis of the air conditioner using the mobile terminal equipment is determined not to be necessary.

6. The mobile terminal equipment according to claim 5, wherein:

the controller selects a countermeasure for the diagnostic result received by the communication device, and the output device displays the countermeasure.

7. The mobile terminal equipment according to claim 6, wherein the countermeasure is a guide to repair the air conditioner.

8. The mobile terminal equipment according to claim 6, wherein the output device displays the received diagnostic result and the countermeasure on a screen of the mobile terminal equipment.

9. The mobile terminal equipment according to claim 8, wherein the screen of the mobile terminal equipment comprises one of a liquid crystal display or an organic light emitting diode.

10. The mobile terminal equipment according to claim 5, wherein the mobile terminal equipment is configured to communicate with one of an indoor device or an outdoor device of the air conditioner.

* * * * *